US009245680B2

(12) United States Patent
Kitamura et al.

(10) Patent No.: US 9,245,680 B2
(45) Date of Patent: Jan. 26, 2016

(54) COMMON MODE CHOKE COIL AND METHOD FOR MANUFACTURING THE SAME

(75) Inventors: Miho Kitamura, Nagaokakyo (JP); Hayami Kudo, Nagaokakyo (JP); Atsushi Yamamoto, Nagaokakyo (JP); Akihiro Nakamura, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 13/601,889

(22) Filed: Aug. 31, 2012

(65) Prior Publication Data

US 2013/0222104 A1 Aug. 29, 2013

(30) Foreign Application Priority Data

Sep. 2, 2011 (JP) ..... 2011-191664

(51) Int. Cl.
*H01F 5/00* (2006.01)
*H01F 27/30* (2006.01)
(Continued)

(52) U.S. Cl.
CPC ..... *H01F 17/0013* (2013.01); *H01F 41/04* (2013.01); *H01F 41/046* (2013.01); *H01F 2017/008* (2013.01); *Y10T 29/49075* (2015.01)

(58) Field of Classification Search
CPC ..... H01F 1/344; H01F 41/04; H01F 41/02; H01F 1/22; H01F 1/00; B22F 1/02; B22F 3/1007; B22F 3/24
USPC ..... 336/199, 200, 205, 206, 207, 208; 257/531; 252/62.62
See application file for complete search history.

(56) References Cited

U.S. PATENT DOCUMENTS 3,660,292 A * 5/1972 Bryce ..... 252/62.6
3,674,694 A * 7/1972 Stadler ..... C04B 35/2658 252/62.59

(Continued)

FOREIGN PATENT DOCUMENTS

CN 1673176 A 9/2005
CN 1993780 A 7/2007

(Continued)

OTHER PUBLICATIONS

An Office Action "Notice of Preliminary Rejection" issued by the Korean Intellectual Property Office on Sep. 5, 2013, which corresponds to Korean Patent Application No. 10-2012-95567.

(Continued)

*Primary Examiner* — Elvin G Enad
*Assistant Examiner* — Joselito Baisa
(74) *Attorney, Agent, or Firm* — Studebaker & Brackett PC

(57) ABSTRACT

There is provided a common mode choke coil in which a non-magnetic layer and a second magnetic layer stacked on a first magnetic layer and two facing conductive coils are included in the non-magnetic layer, the non-magnetic layer is formed of sintered glass ceramics, the conductive coils and are formed of a conductor containing copper, and at least one of the first magnetic layer and the second magnetic layer is formed of a sintered ferrite material containing $Fe_2O_3$, $Mn_2O_3$, NiO, ZnO and CuO. The sintered ferrite material has an $Fe_2O_3$-reduced content of 25 to 47 mol % and a $Mn_2O_3$-reduced content of 1 to 7.5 mol %, or $Fe_2O_3$-reduced content of 35 to 45 mol % and a $Mn_2O_3$-reduced content of 7.5 to 10 mol %, and a CuO reduced content of 5 mol %.

2 Claims, 5 Drawing Sheets

(51) Int. Cl.

| | |
|---|---|
| ***H01F 1/00*** | (2006.01) |
| ***H01F 17/00*** | (2006.01) |
| ***H01F 41/04*** | (2006.01) |

(56) References Cited

U.S. PATENT DOCUMENTS

| | | | | |
|---|---|---|---|---|
| 3,949,032 | A * | 4/1976 | Hossenlopp | C04B 35/265 252/62.62 |
| 4,963,281 | A * | 10/1990 | Togane | 252/62.6 |
| 5,160,379 | A * | 11/1992 | Yoshizawa et al. | 148/108 |
| 5,192,375 | A * | 3/1993 | Sawa et al. | 148/306 |
| 5,250,923 | A * | 10/1993 | Ushiro et al. | 336/83 |
| 6,210,598 | B1 * | 4/2001 | Kobayashi | C04B 35/2658 252/62.57 |
| 6,804,876 | B1 | 10/2004 | Ito et al. | |
| 7,843,701 | B2 * | 11/2010 | Kudo et al. | 361/760 |
| 7,911,295 | B2 | 3/2011 | Inuzuka et al. | |
| 2004/0246088 | A1 | 12/2004 | Shoji et al. | |
| 2005/0062576 | A1 * | 3/2005 | Asakura et al. | 336/233 |
| 2005/0199852 | A1 | 9/2005 | Takenoshita | |
| 2006/0051695 | A1 * | 3/2006 | Yuasa | G03G 9/113 430/111.35 |
| 2007/0077458 | A1 | 4/2007 | Shoji et al. | |
| 2009/0003191 | A1 | 1/2009 | Inuzuka et al. | |
| 2010/0046130 | A1 * | 2/2010 | Park et al. | 361/56 |
| 2010/0127812 | A1 * | 5/2010 | Maeda | H01F 17/0013 336/200 |
| 2010/0283447 | A1 * | 11/2010 | Tachibana et al. | 323/304 |
| 2011/0095856 | A1 | 4/2011 | Nakajima et al. | |
| 2012/0019343 | A1 * | 1/2012 | Hsieh et al. | 336/192 |
| 2012/0297610 | A1 | 11/2012 | Yamamoto et al. | |

FOREIGN PATENT DOCUMENTS

| | | | |
|---|---|---|---|
| CN | 102017028 | A | 4/2011 |
| JP | H03-93667 | A | 4/1991 |
| JP | H07-022266 | A | 1/1995 |
| JP | H07-45932 | A | 2/1995 |
| JP | 2958523 | B1 | 10/1999 |
| JP | 2001-052946 | A | 2/2001 |
| JP | 2005-001894 | A | 1/2005 |
| JP | 2006-319009 | A | 11/2006 |
| JP | 2010-018482 | A | 1/2010 |
| JP | 2010-235324 | A | 10/2010 |
| JP | 2011-192021 | A | 9/2011 |
| KR | 10-2007-0061784 | A | 6/2007 |
| TW | 466514 | B | 12/2001 |
| WO | 2006/121003 | A1 | 11/2006 |
| WO | 2011/093489 | A1 | 8/2011 |

OTHER PUBLICATIONS

An Office Action "Notice of Preliminary Rejection" issued by the Korean Intellectual Property Office on Sep. 5, 2013, which corresponds to Korean Patent Application No. 10-2012-0096118 and is related to U.S. Appl. No. 13/601,842.

An Office Action, "Notification of Reasons for Rejection," issued by the Japanese Patent Office on Jul. 29, 2013, which corresponds to Japanese Patent Application No. 2011-192021 and is related to U.S. Appl. No. 13/601,917; with translation.

An Office Action, "Notification of Reasons for Rejection," issued by the Japanese Patent Office on Jul. 29, 2013, which corresponds to Japanese Patent Application No. 2011-192022 and is related to U.S. Appl. No. 13/601,842; with translation.

An Office Letter; "Preliminary Examination Report, " issued by the Taiwan Intellectual Property Office(TIPO) on Dec. 13, 2013, which corresponds to Taiwan Patent Application No. 101129688.

An Office Action; "Notice of Preliminary Rejection," issued by the Korean Intellectual Property Office on Nov. 11, 2013, which corresponds to Korean Patent Application No. 10-2012-96120.

The first Office Action issued by the State Intellectual Property Office of People's Republic of China on Dec. 30, 2013, which corresponds to Chinese Patent Application No. 201210313966.1.

An Office Letter; "Preliminary Examination Report," issued by the Taiwan Intellectual Property Office(TIPO) on Jul. 9, 2014, which corresponds to Taiwan Patent Application No. 101129688.

The first Office Action issued by the State Intellectual Property Office of People's Republic of China on Oct. 10, 2014, which corresponds to Chinese Patent Application No. 201210313755.8.

* cited by examiner

COMMON MODE CHOKE COIL AND METHOD FOR MANUFACTURING THE SAME

CROSS REFERENCE TO RELATED APPLICATIONS

The present application claims priority to Japanese Patent Application No. 2011-191664 filed on Sep. 2, 2011, the entire contents of this application being incorporated herein by reference in its entirety.

TECHNICAL FIELD

The technical field relates to a common mode choke coil, and more particularly, to a common mode choke coil in which a non-magnetic layer and a second magnetic layer are stacked on a first magnetic layer, and two facing conductive coils are included in the magnetic layers. Also, the technical field relates to a method for manufacturing the common mode choke coil.

BACKGROUND

A common mode choke coil is referred to as a common mode noise filter, and is used to reduce, preferably remove, common mode noise that may be generated in use of various electronic apparatuses. In particular, the common mode noise is problematic in the high-speed data communication through a differential transmission mode, and the common mode choke coil has been widely used for such purpose.

In conventional technology, a configuration in which a non-magnetic layer and a second magnetic layer are stacked on a first magnetic layer and two facing conductive coils are included in the magnetic layers has been known as the common mode choke coil. Glass ceramics may be used as a material of the non-magnetic layer. Therefore, the humidity resistance of the non-magnetic layer and the connection strength between an external end face electrode and a stacked body including the non-magnetic layer may be improved, compared with a case in which a resin such as a polyimide resin or an epoxy resin is used (see Japanese Patent Application Laid-Open No. 2006-319009).

In a common mode choke coil, silver has been generally used as a material of a conductive coil. For example, in Japanese Patent Application Laid-Open No. 2006-319009, silver is used for materials of a conductive coil, glass ceramics are used for a non-magnetic layer, and a Ni—Zn—Cu-based ferrite material containing $Fe_2O_3$ NiO, ZnO, CuO as a major ingredient is used in first and second magnetic layers to obtain a green sheet stacked body, and these elements are co-fired (see Paragraphs [0018] and [0031] of Japanese Patent Application Laid-Open No. 2006-319009).

SUMMARY

The present disclosure provides a common mode choke coil having high reliability, in which the migration between the conductive coils is effectively prevented even when the glass ceramics are used as the material of the non-magnetic layer, and both of an increase in interconnection resistance of the conductive coil and a decrease in specific resistance of the magnetic layer are effectively prevented.

The present disclosure also provides a method for manufacturing a common mode choke coil.

According to one aspect of the disclosure, a common mode choke coil includes a non-magnetic layer and a second magnetic layer stacked on a first magnetic layer and two facing conductive coils in the non-magnetic layer. The non-magnetic layer is formed of sintered glass ceramics, and the conductive coil is formed of a conductor containing copper. At least one of the first magnetic layer and the second magnetic layer (hereinafter referred to as a "second magnetic layer" to simplify the description) is formed of a sintered ferrite material containing $Fe_2O_3$, $Mn_2O_3$, NiO, ZnO and CuO, and the sintered ferrite material has an $Fe_2O_3$-reduced content of not less than 25 mol % but not more than 47 mol % and a $Mn_2O_3$-reduced content of 1 mol % or more and less than 7.5 mol %, or an $Fe_2O_3$-reduced content of not less than 35 mol % but not more than 45 mol % and a $Mn_2O_3$-reduced content of not less than 7.5 mol % but not more than 10 mol %, and a CuO reduced content of 5 mol %.

According to a more specific embodiment of the above a common mode choke coil, the first magnetic layer and the second magnetic layer may be connected through inner coil parts of the two conductive coils disposed in the non-magnetic layer.

Another aspect of the present disclosure is a method for manufacturing a common mode choke coil including a non-magnetic layer and a second magnetic layer stacked on a first magnetic layer and two facing conductive coils included in the non-magnetic layer. The method includes forming the conductive coils using a conductor containing copper, partially forming the non-magnetic layer by firing glass ceramics at an oxygen partial pressure equal to or less than a Cu—$Cu_2O$ average oxygen partial pressure in the presence of the conductor containing copper, and forming the second magnetic layer by firing a sintered ferrite material at an oxygen partial pressure equal to or less than a Cu—$Cu_2O$ average oxygen partial pressure in the presence of the conductor containing copper. The sintered ferrite material used herein contains $Fe_2O_3$, $Mn_2O_2$, NiO, ZnO and CuO, and has an $Fe_2O_3$ content of not less than 25 mol % but not more than 47 mol % and a $Mn_2O_2$ content of 1 mol % or more and less than 7.5 mol %, or an $Fe_2O_3$ content of not less than 35 mol % but not more than 45 mol % and a $Mn_2O_2$ content of not less than 7.5 mol % but not more than 10 mol %, and a CuO reduced content of 5 mol %.

According to a more specific embodiment of the above method of manufacturing a common mode choke coil, the sintered ferrite material may be used as the first magnetic layer.

According to another more specific embodiment of the present disclosure, the above method may further include forming the second magnetic layer by firing a ferrite material at an oxygen partial pressure equal to or less than a Cu—$Cu_2O$ average oxygen partial pressure in the presence of a conductor containing copper. The ferrite material used herein contains $Fe_2O_3$, $Mn_2O_2$, NiO, ZnO and CuO, and has an $Fe_2O_3$ content of not less than 25 mol % but not more than 47 mol % and a $Mn_2O_3$ content of 1 mol % or more and less than 7.5 mol %, or an $Fe_2O_3$ content of not less than 35 mol % but not more than 45 mol % and a $Mn_2O_3$ content of not less than 7.5 mol % but not more than 10 mol %, and a CuO reduced content of 5 mol %. In this case, the firing for forming the non-magnetic layer, the firing for forming the second magnetic layer and the firing for forming the first magnetic layer may be performed at the same time.

According to the present disclosure, a common mode choke coil having high reliability, in which the migration between the conductive coils is effectively prevented even when the glass ceramics are used as the material of the non-magnetic layer, and both of an increase in interconnection resistance of the conductive coil and a decrease in specific resistance of the magnetic layer are effectively prevented, can be manufactured.

BRIEF DESCRIPTION OF THE DRAWINGS

FIG. 1A is a schematic perspective view of the common mode choke coil, and FIG. 1B is a schematic cross-sectional view of the common mode choke coil taken along line X-X' of FIG. 1A.

In FIG. 2, external electrodes are not shown.

DETAILED DESCRIPTION

Figure 1A:
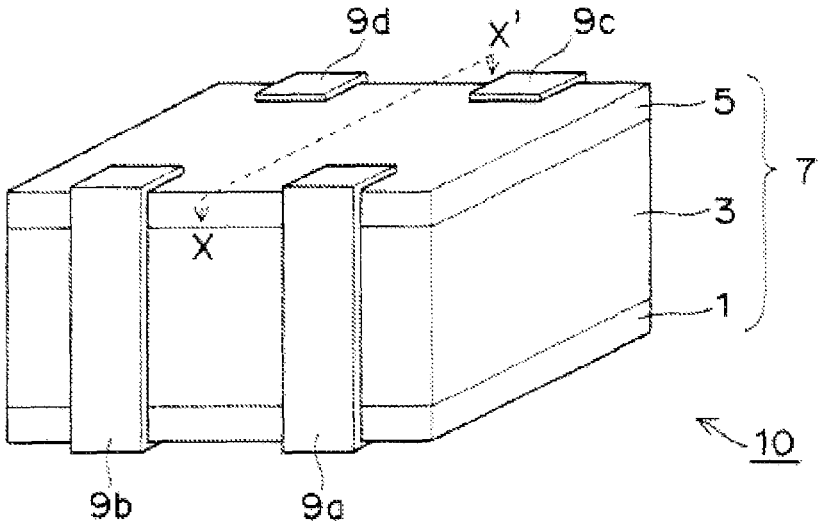
FIGS. 1A and 1B are diagrams showing a common mode choke coil according to an exemplary embodiment.

The inventors realized that silver has a problem in that it easily migrates between two facing conductive coils in the non-magnetic layer (sintered glass ceramics) according to the use circumstances of the common mode choke coil. For this reason, insulation resistance between the conductive coils in the obtained non-magnetic layer may be lowered, and thus the reliability of the common mode choke coil may be degraded. To solve these problems, increasing a distance between the two facing conductive coils may be considered. However, new problems may be caused by increasing the distance between the facing coils, such as a reduced magnetic coupling strength between the coils and reduced performance of the common mode choke coil.

Therefore, using copper, which does not easily migrate, as the material of the conductive coils instead of silver may be considered. However, since copper is more easily oxidized than silver, it is also problematic in that the interconnection resistance of the conductive coils increases as Cu is oxidized into $Cu_2O$ during a firing process. To prevent Cu from being oxidized into $Cu_2O$, performing the firing at an oxygen partial pressure (reducing atmosphere) equal to or less than a Cu—$Cu_2O$ average oxygen partial pressure may be considered. However, when the firing is performed at the oxygen partial pressure equal to or less than the Cu—$Cu_2O$ average oxygen partial pressure, CuO in the Ni—Zn—Cu-based ferrite material is reduced into $Cu_2O$, and $Fe_2O_3$ is also reduced into $Fe_3O_4$. When CuO is reduced into $Cu_2O$ and $Fe_2O_3$ is reduced into $Fe_3O_4$, a reduction in specific resistance of the magnetic layer obtained by the firing may be caused, and the electrical characteristics (common mode impedance, etc.) of the common mode choke coil may be degraded. In particular, for $Fe_2O_3$, a Cu—$Cu_2O$ average oxygen partial pressure is more decreased at a high temperature of 800° C. or more than an $Fe_3O_4$—$Fe_2O_3$ average oxygen partial pressure, and an oxygen partial pressure range in which Cu is predominant over $Cu_2O$ does not overlap an oxygen partial pressure range in which $Fe_2O_3$ is predominant over $Fe_3O_4$, as can be seen from an Ellingham diagram. Also, the firing of the glass ceramics for forming the non-magnetic layer and the Ni—Zn—Cu-based ferrite material for forming the second magnetic layer may not be performed at a temperature of less than 800° C. Therefore, both of oxidation of Cu into $Cu_2O$ and reduction of $Fe_2O_3$ into $Fe_3O_4$ may not be prevented at the same time by adjusting the oxygen partial pressure during the firing, and one of the interconnection resistance of the conductive coil and the specific resistance of the magnetic layer would be sacrificed.

The above-described problems are not limited to a case in which the glass ceramics forming the non-magnetic layer and the Ni—Zn—Cu-based ferrite material forming the first magnetic layer and the second magnetic layer are fired together. Even when the glass ceramics and the Ni—Zn—Cu-based ferrite material are sequentially fired, copper forming the conductive coil cannot be prevented from being exposed to a high temperature atmosphere during the firing process because the exposure is performed in a similar manner.

A common mode choke coil and the method for manufacturing the same that addresses the above shortcomings will now be described in detail with reference to the accompanying drawings.

Figure 1B:
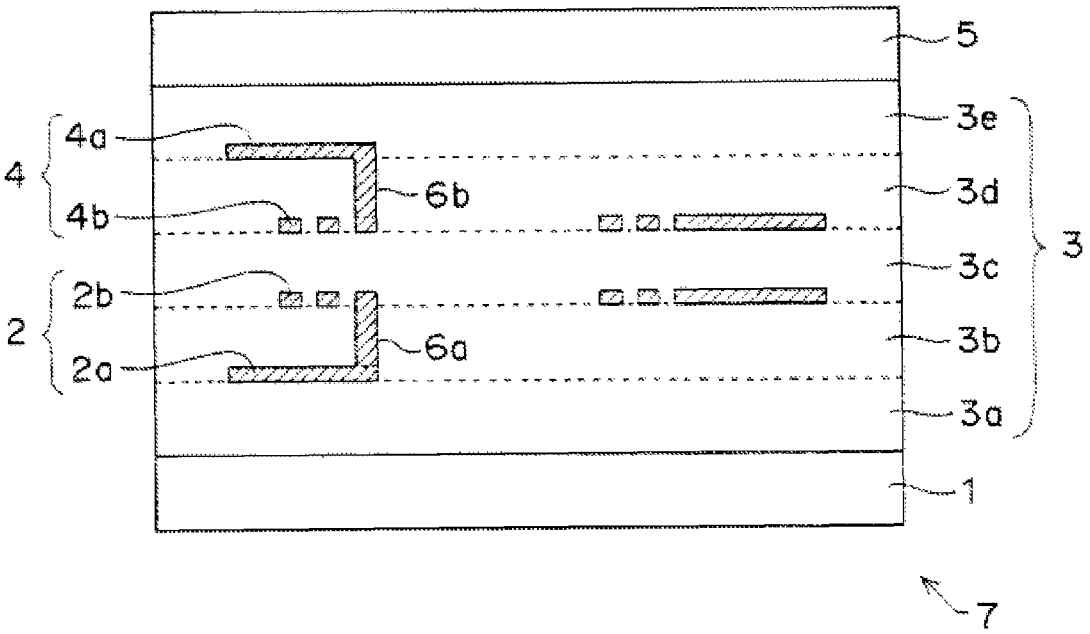
Figure 2:
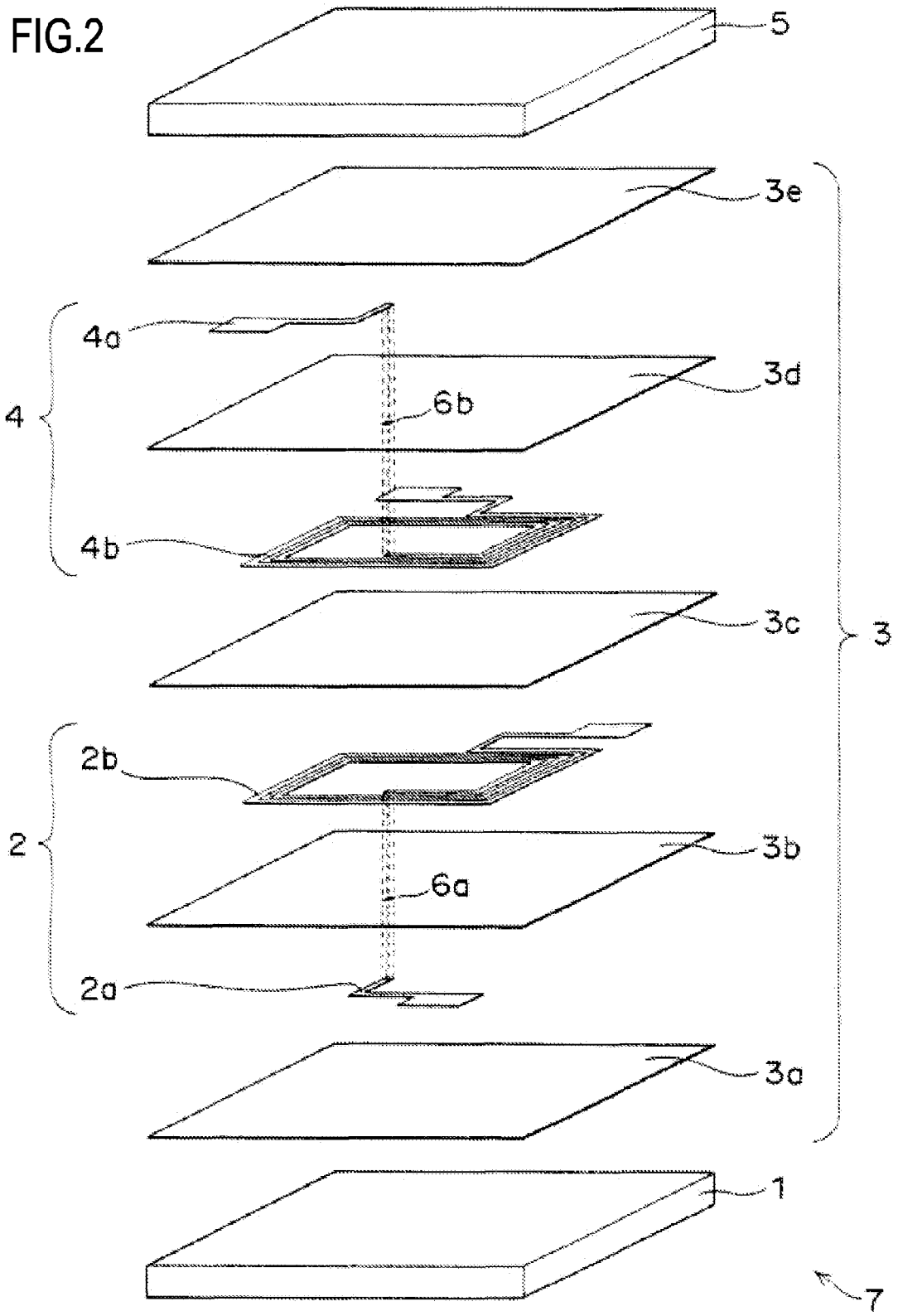
FIG. 2 is a schematic exploded perspective view of the common mode choke coil according to the embodiment of FIGS. 1A and 1B.

As shown in FIGS. 1A, 1B, and 2, a common mode choke coil 10 according to a first exemplary embodiment is configured to include a first magnetic layer 1, and a stacked body 7 including a non-magnetic layer 3 and a second magnetic layer 5, which are sequentially stacked on the first magnetic layer 1. Two conductive coils 2 and 4 are buried in the non-magnetic layer 3 so that the conductive coils 2 and 4 can face each other. External electrodes 9*a* to 9*d* can be formed at the periphery of the stacked body 7, such that both ends of the conductive coil 2 are connected respectively to the external electrodes 9*a* and 9*c*, and both ends of the conductive coil 4 are connected respectively to the external electrodes 9*b* and 9*d*.

Although not intended to limit the present disclosure, more particularly, the non-magnetic layer 3 of the present exemplary embodiment includes non-magnetic sublayers 3*a* to 3*e* made of sintered glass ceramics, as shown in FIG. 1B. Also, the conductive coil 2 includes a withdrawal part 2*a* and a body part 2*b*, and the withdrawal part 2*a* and the body part 2*b* are integrally formed through a via hole 6*a* of the non-magnetic sublayer 3*b*. The conductive coil 4 includes a withdrawal part 4*a* and a body part 4*b*, and the withdrawal part 4*a* and the body part 4*b* are integrally formed through a via hole 6*b* of the non-magnetic sublayer 3*d*. The respective body parts 2*b* and 4*b* have an eddy shape, as shown in FIG. 2, and are provided to face each other with the non-magnetic sublayer 3*c* being sandwiched therebetween. The withdrawal part 2*a* is provided spaced apart from the first magnetic layer 1 by the non-magnetic sublayer 3*a*, and the withdrawal part 4*a* is provided to be spaced apart from the second magnetic layer 5 by the non-magnetic sublayer 3*e*, as shown in FIG. 1B. However, it is noted that the configurations, shapes, eddy numbers and arrangements of the conductive coils 2 and 4 according to this embodiment are exemplary and not limited to the examples shown in FIGS. 1A, 1B, and 2.

According to the present embodiment, the common mode choke coil 10 can be manufactured as described below. Schematically, in the exemplary manufacturing method according to this embodiment, the sintered ferrite material is used for the first magnetic layer 1, the non-magnetic sublayers 3*a* to 3*e* are formed on respective layers by firing to obtain a non-magnetic layer 3, and a second magnetic layer 5 is formed on the non-magnetic layer 3 by firing (i.e., separate sequential firings of the non-magnetic layer and the second magnetic layer).

(a) Preparation of First Magnetic Layer

First, a magnetic substrate formed of a sintered ferrite material is prepared as the first magnetic layer 1. The magnetic substrate formed of the sintered ferrite material may be a substrate obtained by sintering any proper ferrite material as long as the magnetic substrate can have predetermined inductance. For example, a Ni-based ferrite material containing $Fe_2O_3$ and NiO as main ingredients, a Ni—Zn-based ferrite material containing $Fe_2O_3$, NiO and ZnO as main ingredients, and a Ni—Zn—Cu-based ferrite material containing $Fe_2O_3$, NiO, ZnO and CuO as main ingredients may be used as the ferrite material. The magnetic substrate may be a substrate obtained by cutting a substrate, which has been obtained by sintering the proper ferrite material, in a desired shape, but embodiments consistent with the present disclosure are not limited thereto.

(b) Formation of Non-Magnetic Sublayer 3*a*

Next, glass ceramics are stacked on the first magnetic layer 1, and the glass ceramics are fired by heat-treating the obtained stacked body, thereby forming a non-magnetic sublayer 3*a*. Photosensitive or non-photosensitive glass ceramics may be used as the glass ceramics that are raw materials. However, the same (photosensitive) glass ceramics as the non-magnetic sublayer 3*b* are preferably used. For example, borosilicate glass (glass including silicon dioxide as a main ingredient and also including boric acid and optionally another compound), and borosilicate-free glass (glass including silicon dioxide as a main ingredient and also optionally including another compound without using boric acid) may be used as the glass ceramics. The stacking of the glass ceramics on the first magnetic layer 1 may be performed by coating a paste (hereinafter simply referred to as a glass paste), which is obtained using the glass ceramics with any other proper insulating components, on the first magnetic layer 1 using a method such as printing, or by stacking a green sheet (hereinafter simply referred to as a glass ceramic green sheet), which is obtained using the glass ceramics with any other proper insulating components, on the first magnetic layer 1. The firing (heat treatment) for forming the non-magnetic sublayer 3*a* may be performed with no particular limitation as long as it can be used to sinter the glass ceramics. In this process, since the conductor containing copper is not yet present in the stacked body, the stacked body may be heat-treated in the air to fire the glass ceramics. The firing temperature is not particularly limited as long as the firing temperature is higher than a softening point of glass. For example, the firing temperature may be in a range of 800 to 1,000° C.

(c) Formation of Withdrawal Part 2*a* of Conductive Coil 2

Subsequently, a pattern of the conductor containing copper is formed on the non-magnetic sublayer (sintered glass ceramics layer) 3*a* to form a withdrawal part 2*a*. The conductor containing copper includes copper as a main ingredient, and may include another conductive component, as necessary. The pattern formation of the conductor containing copper may be performed by screen-printing a paste, which is obtained using powder of copper (and another conductive component, as necessary; the same will apply hereinafter) with glass, on the non-magnetic sublayer 3*a* in a predetermined pattern, forming a film of copper on the non-magnetic sublayer 3*a* using a sputtering process and etching the film with a predetermined pattern using photolithography, or selectively plating copper in a predetermined pattern. The selective plating may be performed, for example, using a fully additive process (a method using resist pattern formation, electroless plating, and resist peeling), or a semi-additive process (a method using film formation of a seed layer using electroless plating, resist pattern formation, electroplating, resist peeling, seed layer removal, etc.).

(d) Formation of Non-Magnetic Sublayer 3*b*

Thereafter, the glass ceramics are stacked on the non-magnetic sublayer (sintered glass ceramics layer) 3*a* and the withdrawal part 2*a* in a similar manner as in process (b). In this process, however, photosensitive glass ceramics are used as the glass ceramics that are raw materials, and a via hole 6*a* is formed in this layer using photolithography to partly expose the withdrawal part 2*a*. Then, the glass ceramics are fired by heat-treating the obtained stacked body, thereby forming a non-magnetic sublayer 3*b*. The firing (heat treatment) for forming the non-magnetic sublayer 3*b* is performed by heat-treating the stacked body under an atmosphere equal to or less than the Cu—$Cu_2O$ average oxygen partial pressure and firing the glass ceramics under the atmosphere. In this process, the conductor containing copper is present in the stacked body. Thus, oxidation of Cu into $Cu_2O$ may be prevented by firing the glass ceramics under the atmosphere of the oxygen partial pressure equal to or less than the Cu—$Cu_2O$ average oxygen partial pressure. The oxygen partial pressure of the firing atmosphere may be equal to or less than the Cu—$Cu_2O$ average oxygen partial pressure. The firing temperature is not particularly limited as long as the firing temperature is higher than a softening point of glass. For example, the firing temperature may be in a range of 800 to 1,000° C. The Cu—$Cu_2O$ average oxygen partial pressure varies according to a temperature, and may be calculated from the Ellingham diagram. For example, the Cu—$Cu_2O$ average oxygen partial pressure is $4.3\times10^{-2}$ Pa at a temperature of 900° C., $1.8\times10^{-2}$ Pa at a temperature of 950° C., and $6.7\times10^{-2}$ Pa at a temperature of 1,000° C.

(e) Formation of Body Part 2*b* of Conductive Coil 2

Then, a pattern of the conductor containing copper is formed at an inner part of the via hole 6*a* and formed on the non-magnetic sublayer (sintered glass ceramics layer) 3*b*, thereby forming a body part 2*b* in an eddy shape. The pattern formation of the conductor containing copper may be performed in a similar manner as in process (c). However, the conductor containing copper is buried in the via hole 6*a* to connect the body part 2*b* and the withdrawal part 2*a*. In this case, the body part 2*b* and the withdrawal part 2*a* are integrally formed to constitute the conductive coil 2.

(f) Formation of Non-Magnetic Sublayer 3*c*

Thereafter, the glass ceramics are stacked on the non-magnetic sublayer (sintered ceramics layer) 3*b* and the body part 2*b* in a similar manner as in process (b). Then, the glass ceramics are fired by heat-treating the obtained stacked body, thereby forming a non-magnetic sublayer 3*c*. Like process (d), the firing (heat treatment) for forming the non-magnetic sublayer 3*c* is performed by heat-treating the stacked body under an atmosphere equal to or less than the Cu—$Cu_2O$ average oxygen partial pressure and firing the glass ceramics under the atmosphere.

(g) Formation of Body Part 4*b* of Conductive Coil 4

Then, a pattern of the conductor containing copper is formed on the non-magnetic sublayer (sintered glass ceramics layer) 3*c* to form a body part 4*b* in an eddy shape. The pattern formation of the conductor containing copper may be performed in a similar manner as in process (c).

(h) Formation of Non-Magnetic Sublayer 3*d*

Thereafter, the glass ceramics are stacked on the non-magnetic sublayer (sintered glass ceramics layer) 3*c* and the body part 4*b* in a similar manner as in process (b). In this process, however, photosensitive glass ceramics are used as the glass ceramics that are raw materials, and a via hole 6*b* is formed in this layer using photolithography to partly expose the body part 4*b*. Then, the glass ceramics are fired by heat-treating the obtained stacked body, thereby forming a non-magnetic sublayer 3*d*. Like process (d), the firing (heat treatment) for forming the non-magnetic sublayer 3*d* is performed by heat-treating the stacked body under an atmosphere equal to or less than the Cu—$Cu_2O$ average oxygen partial pressure and firing the glass ceramics under the atmosphere.

(i) Formation of Withdrawal Part 4*a* of Conductive Coil 4

Subsequently, a pattern of the conductor containing copper is formed at an inner part of the via hole 6*b* and formed on the non-magnetic sublayer (sintered ceramics layer) 3*d*, thereby forming a withdrawal part 4*a*. The pattern formation of the conductor containing copper may be performed in a similar manner as in process (c). However, the conductor containing copper is buried in the via hole 6*b* to connect the body part 4*b* and the withdrawal part 4*a*. In this case, the body part 4*b* and the withdrawal part 4*a* are integrally formed to constitute the conductive coil 4.

(j) Formation of Non-Magnetic Sublayer 3*e*

Thereafter, the glass ceramics are stacked on the non-magnetic sublayer (sintered glass ceramics layer) 3*d* and the withdrawal part 4*a* in a similar manner as in process (b). Then, the glass ceramics are fired by heat-treating the obtained stacked body, thereby forming a non-magnetic sublayer 3*e*. Like process (d), the firing (heat treatment) for forming the non-magnetic sublayer 3*e* is performed by heat-treating the stacked body under an atmosphere equal to or less than the Cu—$Cu_2O$ average oxygen partial pressure and firing the glass ceramics under the atmosphere. All the non-magnetic sublayers 3*a* to 3*e* are sintered by formation of the non-magnetic sublayer 3*e*, and constitute the non-magnetic layer 3 (sintered glass ceramics layer) as a whole.

(k) Formation of Second Magnetic Layer 5

Separately, as the Ni—Mn—Zn—Cu-based ferrite material containing $Fe_2O_3$, $Mn_2O_3$, NiO, ZnO and CuO, a ferrite material in which a CuO content, an $Fe_2O_3$ content and an $Mn_2O_3$ content are present within predetermined ranges is prepared. It is to be understood that a predetermined amount of $Fe_2O_3$ is replaced with $Mn_2O_3$ in the Ni—Zn—Cu-based ferrite material.

The ferrite material contains $Fe_2O_3$, $Mn_2O_3$, NiO, ZnO and CuO as main ingredients, and may further include an additional component such as $Bi_2O_3$, as necessary. In general, the ferrite material is a raw material that may be prepared by mixing powders of these components at a desired ratio and calcining the mixture, but embodiments consistent with the present disclosure are not limited thereto.

In the ferrite material, the CuO content is set to 5 mol % or less (based on the sum of the main ingredients). When the CuO content is 5 mol % or less, high specific resistance for the second magnetic layer 5 may be secured by firing the ferrite material using heat treatment as will be described below. The CuO content in the ferrite material may be 5 mol % or less. To obtain a sufficient sintering property, the CuO content is preferably 0.2 mol % or more.

Figure 3:
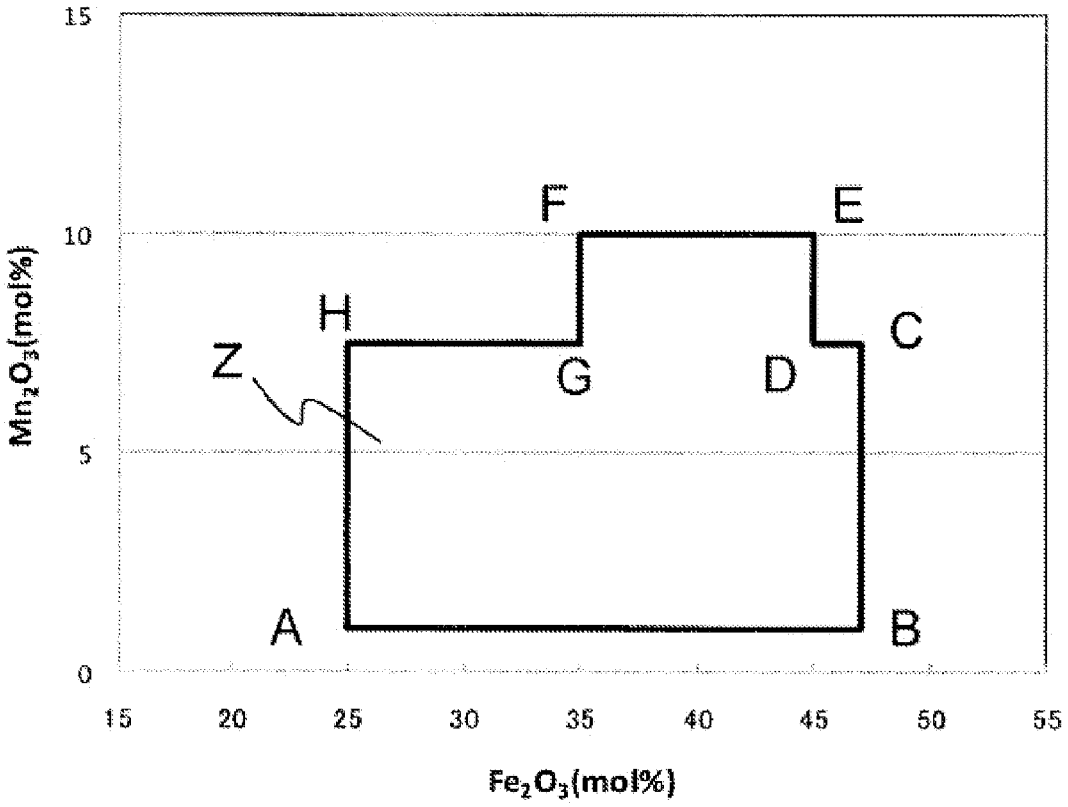
FIG. 3 is a graph illustrating an $Fe_2O_3$ content (mol %) and a $Mn_2O_3$ content (mol %) in a ferrite material containing $Fe_2O_3$, $Mn_2O_3$, NiO, ZnO and CuO.

In the ferrite material, the $Fe_2O_3$ content and the $Mn_2O_3$ content (based on the sum of the main ingredients) is set to a range of zone Z shown in FIG. 3. FIG. 3 is a graph obtained when the $Fe_2O_3$ content is plotted on the x axis and the $Mn_2O_3$ content is plotted on the y axis. In FIG. 3, respective points (x, y) correspond to A (25, 1), B (47, 1), C (47, 7.5), D (45, 7.5), E (45, 10), F (35, 10), G (35, 7.5) and H (25, 7.5). That is, a range of zone Z surrounded by these points A to H corresponds to the sum of a zone in which the $Fe_2O_3$ content is in a range of not less than 25 mol % but not more than 47 mol % and the $Mn_2O_3$ content is 1 mol % or more and less than 7.5 mol % and a zone in which the $Fe_2O_3$ content is in a range of not less than 35 mol % but not more than 45 mol % and the $Mn_2O_3$ content is in a range of not less than 7.5 mol % but not more than 10 mol %. When it is assumed that the $Fe_2O_3$ content and the $Mn_2O_3$ content are set within this range of zone Z shown in FIG. 3, high specific resistance for the second magnetic layer 5 may be secured by firing the ferrite material using heat treatment as will be described below.

In the ferrite material, the ZnO content is preferably in a range of 6 to 33 mol % (based on the sum of the main ingredients). When the ZnO content is set to 6 mol % or more, for example, a high magnetic permeability of 35 or more may be yielded, and the high inductance may be obtained. Also, when the ZnO content is set to 33 mol % or less, for example, a Curie point of 130° C. or higher may be obtained, and a high coil operating temperature may be secured.

In the ferrite material, the NiO content is not particularly limited, and may be set as the remainder of the other main ingredients, CuO, $Fe_2O_3$ and ZnO, as described above.

Also, the $Bi_2O_3$ content (amount added) in the ferrite material is preferably in a range of 0.1 to 1 parts by weight, based on 100 parts by weight of the sum of the main ingredients ($Fe_2O_3$, $Mn_2O_3$, ZnO, NiO and CuO). When the $Bi_2O_3$ content is set to 0.1 to 1 parts by weight, the low-temperature firing is facilitated, and the abnormal grain growth may also be prevented. When the $Bi_2O_3$ content is too high, abnormal grain growth is easily caused, which is not desirable, the specific resistance is lowered in an abnormal grain growth region, and plating may be attached to the abnormal grain growth region during the plating process in formation of external electrodes.

By using such a Ni—Mn—Zn—Cu-based ferrite material, the ferrite material is stacked on the non-magnetic layer 3 of the stacked body obtained in process (j). Then, the ferrite material is fired by heat-treating the obtained stacked body, thereby forming a second magnetic layer 5. The stacking of the ferrite material on the non-magnetic layer 3 may be performed by coating a paste, which is obtained using the above-described ferrite material together with any of other proper components, on the non-magnetic layer 3 using a method such as printing, or by stacking a green sheet, which is obtained using the above-described ferrite material together with any of other proper components, on the non-magnetic layer 3. The firing (heat treatment) for forming the second magnetic layer 5 is performed by heat-treating the stacked body under an atmosphere equal to or less than the Cu—$Cu_2O$ average oxygen partial pressure and firing the ferrite material under the atmosphere.

When the ferrite material is fired under the atmosphere equal to or less than the Cu—$Cu_2O$ average oxygen partial pressure, the sintering may be performed at a lower low temperature than when the ferrite material is fired in the air. For example, the sintering may be performed at a firing temperature of 950 to 1,000° C. Although the present disclosure is not limited by any theory, it is noted that, when the firing is performed under the atmosphere of a low oxygen partial pressure as described above, oxygen vacancies may be formed in a crystal structure, interdiffusion of Fe, Mn, Ni, Cu and Zn present in the crystals may be facilitated, and a low-temperature sintering property may be improved. In this process, the conductor containing copper is present in the stacked body. However, when the ferrite material is subjected to low-temperature firing under the atmosphere equal to or less than the Cu—$Cu_2O$ average oxygen partial pressure, Cu in the ferrite material may be prevented from being oxidized into $Cu_2O$, and the interconnection resistance of the coil conductors 2 and 4 may be maintained at a low level.

In addition, even when the firing is performed under the atmosphere equal to or less than the Cu—$Cu_2O$ average oxygen partial pressure, the high specific resistance for the second magnetic layer 5 may be secured using the Ni—Mn—

Zn—Cu-based ferrite material whose CuO content is 5 mol % or less. Although the present disclosure is not limited by any theory, it is noted that generation of $Cu_2O$ caused by the reduction of CuO may be suppressed by reducing the CuO content, and thus a decrease in specific resistance may be suppressed.

Also, even when the firing is performed under the atmosphere equal to or less than the Cu—$Cu_2O$ average oxygen partial pressure, the high specific resistance for the second magnetic layer 5 may be secured using the Ni—Mn—Zn—Cu-based ferrite material whose $Fe_2O_3$ content and $Mn_2O_3$ content are present within a range of zone Z shown in FIG. 3. Although the present disclosure is not limited by any theory, it is noted that, since a $Mn_3O_4$—$Mn_2O_3$ average oxygen partial pressure is higher than an $Fe_3O_4$—$Fe_2O_3$ average oxygen partial pressure, and $Mn_2O_3$ is more easily reduced than $Fe_2O_3$, a stronger reductive atmosphere for $Mn_2O_3$ than $Fe_2O_3$ is promoted at the oxygen partial pressure equal to or less than the CuO—$Cu_2O$ average oxygen partial pressure. As a result, $Mn_2O_3$ is preferentially reduced over $Fe_2O_3$, and the firing may be completed before reduction of $Fe_2O_3$.

The oxygen partial pressure of the firing atmosphere is desirable as long as the oxygen partial pressure is equal to or less than the CuO—$Cu_2O$ average oxygen partial pressure. To secure the specific resistance of the second magnetic layer, the oxygen partial pressure is preferably 0.01 times the CuO—$Cu_2O$ average oxygen partial pressure (Pa). Although the present disclosure is not limited by any theory, it is noted that, when a concentration of oxygen is too low, excessive oxygen vacancies may be generated so that the specific resistance of the second magnetic layer 5 can be lowered, and excessive generation of the oxygen vacancies may be prevented when a predetermined amount of oxygen is present, thereby securing the high specific resistance.

Therefore, a stacked body 7 in which the non-magnetic layer 3 and the second magnetic layer 5 are stacked on the first magnetic layer 1 and two facing conductive coils 2 and 4 are included in the non-magnetic layer 3 is obtained. The stacked body 7 may be individually manufactured, but the plurality of stacked bodies 7 may be collectively manufactured in a matrix shape, and individually divided into pieces (separated into devices) by dicing.

(l) Formation of External Electrodes 9*a* to 9*d*

External electrodes 9*a* to 9*d* are formed on facing lateral portions of the stacked body 7. The formation of the external electrodes 9*a* to 9*d* may be performed, for example, by applying a paste, which is obtained using copper powder with glass, on a predetermined zone, and baking copper by heat-treating the obtained structure, for example, at 850 to 900° C. under an atmosphere of an oxygen partial pressure equal to or less than the CuO—$Cu_2O$ average oxygen partial pressure.

As described above, the common mode choke coil 10 according to this embodiment is manufactured. In the common mode choke coil 10, the second magnetic layer 5 is formed of a sintered ferrite material containing $Fe_2O_3$, $Mn_2O_3$, NiO, ZnO and CuO. However, the compositions of the sintered ferrite material may be different from a ferrite material before sintering. For example, portions of CuO, $Fe_2O_3$ and $Mn_2O_3$ may be converted into $Cu_2O$, $Fe_3O_4$ and $Mn_3O_4$ by firing, respectively. In the sintered ferrite material, however, it may be noted that the CuO-reduced content, the $Fe_2O_3$-reduced content and the $Mn_2O_3$-reduced content are not substantially different from the CuO content, the $Fe_2O_3$ content and the $Mn_2O_3$ content in the ferrite material before the sintering, respectively.

According to the present embodiment, since copper is used as the material of the conductive coils 2 and 4, migration between the conductive coils 2 and 4 may be effectively prevented, and a common mode choke coil having high reliability may be obtained. Also, the interconnection resistance of the conductive coils 2 and 4 may be maintained at a low level, and the second magnetic layer 5 may also have a good low-temperature sintering property. In addition, the specific resistance of the second magnetic layer 5 may be maintained at a high level. For example, the specific resistance ρ may be yielded as a log ρ of 7 or more.

Also, according to this embodiment, since the migration between the conductive coils 2 and 4 may be effectively prevented as described above, a magnetic coupling property (or coupling coefficient) between the conductive coils 2 and 4 may be strengthened, and the common mode choke coil showing further improved common mode impedance may be obtained. Also, a distance between the conductive coils 2 and 4 may be reduced, and thus it is possible to manufacture a thinner film of the common mode choke coil.

Embodiment 2

In the second exemplary embodiment, the common mode choke coil 10 described above in the first embodiment is manufactured using separate methods. Hereinafter, like members in the first exemplary embodiment are described as like reference numerals. Schematically, the manufacturing method according to this embodiment includes stacking a material of the first magnetic layer 1 on a holding layer using a substrate-less process, stacking a material of the non-magnetic layer 3 (while forming the conductive coils 2 and 4), stacking a material of the second magnetic layer 5 on the non-magnetic layer 3, and collectively firing the obtained stacked body to form the first magnetic layer 1, the non-magnetic layer 3 and the second magnetic layer 5 (co-firing of the first magnetic layer, the non-magnetic layer and the second magnetic layer).

(m) Formation of Material Layer of First Magnetic Layer 1

A predetermined ferrite material is stacked on any proper holding layer (not shown) to form a material layer of the first magnetic layer 1. The Ni—Mn—Zn—Cu-based ferrite material that is similar to that described above for the second magnetic layer 5 in process (k) of the first embodiment is used as the ferrite material. The stacking of the ferrite material on the holding layer may be performed by coating a paste, which is obtained using a ferrite material with any other proper components, on the holding layer using a method such as printing and drying the paste, or stacking a green sheet, which is obtained using a ferrite material with any other proper components, on a holding layer.

(n) Stacking of Materials of Non-Magnetic Sublayers 3*a* to 3*e* and Formation of Conductive Coils 2 and 4

Material layers (unsintered glass ceramic material layers) of the non-magnetic sublayers 3*a* to 3*e* are stacked while forming the conductive coils 2 and 4 in a similar manner as in the above-described processes (b) to (j) of the first embodiment except that the firing is not performed in each process to form the non-magnetic sublayers 3*a* to 3*e* on a material layer (unsintered Ni—Mn—Zn—Cu-based ferrite material) of the first magnetic layer 1. Therefore, the material layer of the non-magnetic layer 3 is formed with conductive coils 2 and 4 buried therein.

(o) Formation of Material Layer of Second Magnetic Layer 5

Thereafter, a material layer of the second magnetic layer 5 is formed by stacking a predetermined ferrite material on the material layer of the non-magnetic layer 3 in a similar manner as in process (m). The Ni—Mn—Zn—Cu-based ferrite material that is similar to that described above for the second magnetic layer 5 in process (k) of the first embodiment is used as the ferrite material. As long as these conditions are satisfied, the material of the first magnetic layer 1 and the material of the second magnetic layer 5 may be the same as or different from each other.

Therefore, an unfired stacked body is obtained. The unfired stacked body may be individually manufactured, or the plurality of unfired stacked bodies may be collectively manufactured in a matrix shape and individually divided into pieces (separated into devices) by dicing.

(p) Formation of First Magnetic Layer 1, Non-Magnetic Layer 3 and Second Magnetic Layer 5

Glass ceramics are fired by heat-treating the unfired stacked body obtained as described above, thereby forming the non-magnetic layer 3. Also, a ferrite material is fired to form the first magnetic layer 1 and the second magnetic layer 5. The firing (heat treatment) for forming the first magnetic layer 1, the non-magnetic layer 3 and the second magnetic layer 5 is performed by heat-treating the stacked body under an atmosphere equal to or less than the Cu—$Cu_2O$ average oxygen partial pressure, and firing the glass ceramics and the ferrite material under the atmosphere at the same time.

Therefore, a stacked body 7 in which the non-magnetic layer 3 and the second magnetic layer 5 are stacked on the first magnetic layer 1, and two facing conductive coils 2 and 4 are included in the non-magnetic layer 3 is obtained.

(q) Formation of External Electrodes 9*a* to 9*d*

Thereafter, external electrodes 9*a* to 9*d* are formed on facing lateral portions of the stacked body 7 in a similar manner as in the above-described process (l) of the first embodiment.

The common mode choke coil 10 according to this embodiment is manufactured, as described above. According to this embodiment, the firing (heat treatment) for forming the non-magnetic layer 3 and the second magnetic layer is completed through a single process, unlike the manufacturing method of the first embodiment. Thus, Cu used in the material of the conductive coil may be further prevented from being oxidized into $Cu_2O$, and the common mode choke coil having higher reliability may be obtained. In addition, effects similar to those of the first embodiment may be achieved.

Figure 4:
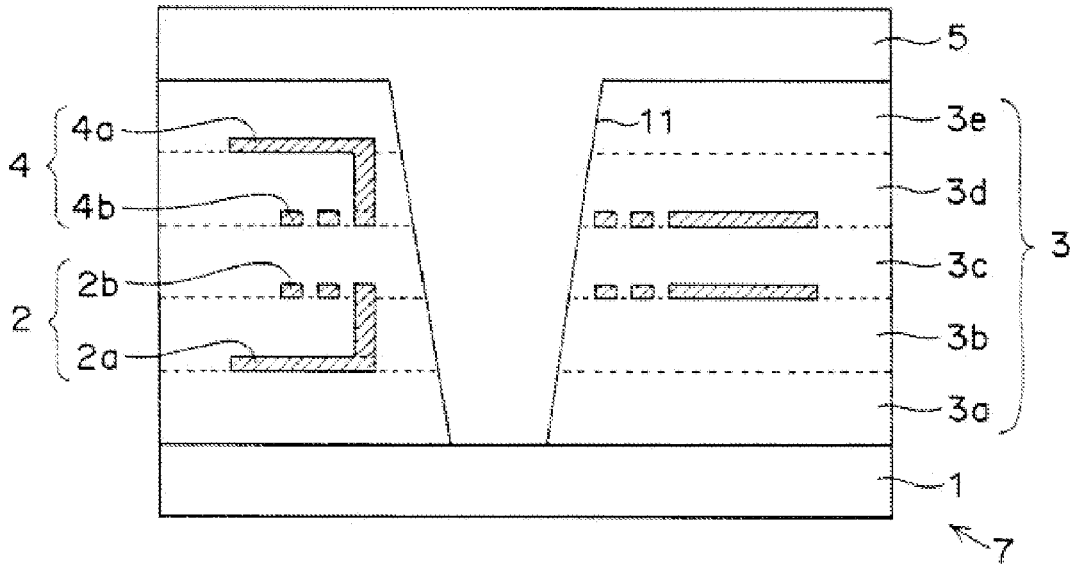
FIG. 4 is a diagram showing a common mode choke coil according to a modification of the embodiment of FIG. 1B.

As described above, although the two exemplary embodiments of the present disclosure have been described, various modifications may be made to these embodiments. For example, in the common mode choke coils according to the first and second embodiments, a through hole 11 passing through the non-magnetic layer 3 is formed using a sand blasting process or an etching process so that the conductive coils 2 and 4 cannot be exposed from the non-magnetic layer 3, as shown in FIG. 4. Here, the through hole may be buried in the Ni—Mn—Zn—Cu-based ferrite material that is similar to that that described above for the second magnetic layer 5 in process (k) of the first embodiment. Also, the ferrite material may be the same as or different from the material (and the material of the first magnetic layer 1 in the case of the second embodiment) of the second magnetic layer 5. According to this configuration, a magnetic coupling property between the conductive coils 2 and 4 may be strengthened, and the common mode choke coils having higher common mode impedance may be obtained.

EXAMPLES

Experiments

To screen a ferrite material that is suitable for use as the material of the second magnetic layer, the following experiments were performed to evaluate reducing resistance of ferrite materials having various compositions.

As raw materials of the ferrite material, powders of $Fe_2O_3$, $Mn_2O_3$, ZnO, NiO and CuO were prepared, and weighed so that the compositions of the ferrite material could be in a ratio listed in Tables 1 to 5. Also, in the Tables, the marking of the symbol "*" on the sample numbers means that the composition of the ferrite material departs from the scope of the present disclosure, and the absence of the symbol "*" on the sample numbers means that the composition of the ferrite material falls within the scope of the present disclosure.

TABLE 1

| | Ferrite material compositions (mol %) | | | | | Electric characteristics | |
|---|---|---|---|---|---|---|---|
| | | | | | | Specific resistance log ρ | Magnetic permeability μ |
| No. | $Fe_2O_3$ | $Mn_2O_3$ | ZnO | CuO | NiO | (Ω · cm) | (—) |
| 1* | 49.0 | 0.0 | 30.0 | 1.0 | 20.0 | 2.8 | 350 |
| 2* | 49.0 | 1.0 | 30.0 | 1.0 | 19.0 | 3.3 | 400 |
| 3* | 49.0 | 2.0 | 30.0 | 1.0 | 18.0 | 3.4 | 600 |
| 4* | 49.0 | 5.0 | 30.0 | 1.0 | 15.0 | 3.4 | 750 |
| 5* | 49.0 | 7.5 | 30.0 | 1.0 | 12.5 | 3.4 | 900 |
| 6* | 49.0 | 10.0 | 30.0 | 1.0 | 10.0 | 3.4 | 1100 |
| 7* | 49.0 | 13.0 | 30.0 | 1.0 | 7.0 | 3.3 | 1250 |
| 8* | 49.0 | 15.0 | 30.0 | 1.0 | 5.0 | 3.1 | 1450 |
| 9* | 48.0 | 0.0 | 30.0 | 1.0 | 21.0 | 4.4 | 290 |
| 10* | 48.0 | 1.0 | 30.0 | 1.0 | 20.0 | 5.9 | 330 |
| 11* | 48.0 | 2.0 | 30.0 | 1.0 | 19.0 | 6.3 | 500 |
| 12* | 48.0 | 5.0 | 30.0 | 1.0 | 16.0 | 6.1 | 640 |
| 13* | 48.0 | 7.5 | 30.0 | 1.0 | 13.5 | 5.9 | 760 |
| 14* | 48.0 | 10.0 | 30.0 | 1.0 | 11.0 | 5.6 | 900 |
| 15* | 48.0 | 13.0 | 30.0 | 1.0 | 8.0 | 5.0 | 1050 |
| 16* | 48.0 | 15.0 | 30.0 | 1.0 | 6.0 | 4.3 | 1250 |
| 17* | 47.0 | 0.0 | 30.0 | 1.0 | 22.0 | 5.3 | 235 |
| 18 | 47.0 | 1.0 | 30.0 | 1.0 | 21.0 | 7.0 | 260 |
| 19 | 47.0 | 2.0 | 30.0 | 1.0 | 20.0 | 7.5 | 400 |
| 20 | 47.0 | 5.0 | 30.0 | 1.0 | 17.0 | 7.3 | 520 |
| 21 | 47.0 | 7.5 | 30.0 | 1.0 | 14.5 | 7.0 | 625 |
| 22* | 47.0 | 10.0 | 30.0 | 1.0 | 12.0 | 6.4 | 750 |
| 23* | 47.0 | 13.0 | 30.0 | 1.0 | 9.0 | 5.6 | 880 |
| 24* | 47.0 | 15.0 | 30.0 | 1.0 | 7.0 | 4.9 | 1050 |
| 25* | 46.0 | 0.0 | 30.0 | 1.0 | 23.0 | 5.9 | 195 |
| 26 | 46.0 | 1.0 | 30.0 | 1.0 | 22.0 | 7.4 | 215 |
| 27 | 46.0 | 2.0 | 30.0 | 1.0 | 21.0 | 7.6 | 320 |
| 28 | 46.0 | 5.0 | 30.0 | 1.0 | 18.0 | 7.5 | 430 |
| 29 | 46.0 | 7.5 | 30.0 | 1.0 | 15.5 | 7.3 | 520 |
| 30* | 46.0 | 10.0 | 30.0 | 1.0 | 13.0 | 6.8 | 630 |
| 31* | 46.0 | 13.0 | 30.0 | 1.0 | 10.0 | 6.0 | 730 |
| 32* | 46.0 | 15.0 | 30.0 | 1.0 | 8.0 | 5.2 | 880 |
| 33* | 45.0 | 0.0 | 30.0 | 1.0 | 24.0 | 6.2 | 165 |
| 34 | 45.0 | 1.0 | 30.0 | 1.0 | 23.0 | 7.7 | 180 |
| 35 | 45.0 | 2.0 | 30.0 | 1.0 | 22.0 | 7.9 | 250 |
| 36 | 45.0 | 5.0 | 30.0 | 1.0 | 19.0 | 7.8 | 340 |
| 37 | 45.0 | 7.5 | 30.0 | 1.0 | 16.5 | 7.6 | 420 |
| 38 | 45.0 | 10.0 | 30.0 | 1.0 | 14.0 | 7.1 | 520 |
| 39* | 45.0 | 13.0 | 30.0 | 1.0 | 11.0 | 6.3 | 600 |
| 40* | 45.0 | 15.0 | 30.0 | 1.0 | 9.0 | 5.4 | 720 |

TABLE 2

| | Ferrite material compositions (mol %) | | | | | Electric characteristics | |
|---|---|---|---|---|---|---|---|
| | | | | | | Specific resistance log ρ | Magnetic permeability μ |
| No. | $Fe_2O_3$ | $Mn_2O_3$ | ZnO | CuO | NiO | (Ω · cm) | (—) |
| 41* | 44.0 | 0.0 | 30.0 | 1.0 | 25.0 | 6.4 | 145 |
| 42 | 44.0 | 1.0 | 30.0 | 1.0 | 24.0 | 7.9 | 155 |
| 43 | 44.0 | 2.0 | 30.0 | 1.0 | 23.0 | 8.0 | 210 |
| 44 | 44.0 | 5.0 | 30.0 | 1.0 | 20.0 | 8.0 | 280 |

TABLE 2-continued

| No. | Ferrite material compositions (mol %) $Fe_2O_3$ | $Mn_2O_3$ | ZnO | CuO | NiO | Electric characteristics Specific resistance log ρ (Ω · cm) | Magnetic permeability μ (—) |
|---|---|---|---|---|---|---|---|
| 45 | 44.0 | 7.5 | 30.0 | 1.0 | 17.5 | 7.8 | 340 |
| 46 | 44.0 | 10.0 | 30.0 | 1.0 | 15.0 | 7.3 | 420 |
| 47* | 44.0 | 13.0 | 30.0 | 1.0 | 12.0 | 6.5 | 490 |
| 48* | 44.0 | 15.0 | 30.0 | 1.0 | 10.0 | 5.7 | 590 |
| 49* | 42.0 | 0.0 | 30.0 | 1.0 | 27.0 | 6.6 | 115 |
| 50 | 42.0 | 1.0 | 30.0 | 1.0 | 26.0 | 7.9 | 125 |
| 51 | 42.0 | 2.0 | 30.0 | 1.0 | 25.0 | 8.2 | 160 |
| 52 | 42.0 | 5.0 | 30.0 | 1.0 | 22.0 | 8.2 | 205 |
| 53 | 42.0 | 7.5 | 30.0 | 1.0 | 19.5 | 7.9 | 235 |
| 54 | 42.0 | 10.0 | 30.0 | 1.0 | 17.0 | 7.5 | 280 |
| 55* | 42.0 | 13.0 | 30.0 | 1.0 | 14.0 | 6.7 | 340 |
| 56* | 42.0 | 15.0 | 30.0 | 1.0 | 12.0 | 5.9 | 420 |
| 57* | 40.0 | 0.0 | 30.0 | 1.0 | 29.0 | 6.5 | 100 |
| 58 | 40.0 | 1.0 | 30.0 | 1.0 | 28.0 | 7.9 | 108 |
| 59 | 40.0 | 2.0 | 30.0 | 1.0 | 27.0 | 8.0 | 130 |
| 60 | 40.0 | 5.0 | 30.0 | 1.0 | 24.0 | 8.0 | 160 |
| 61 | 40.0 | 7.5 | 30.0 | 1.0 | 21.5 | 7.8 | 185 |
| 62 | 40.0 | 10.0 | 30.0 | 1.0 | 19.0 | 7.3 | 215 |
| 63* | 40.0 | 13.0 | 30.0 | 1.0 | 16.0 | 6.5 | 260 |
| 64* | 40.0 | 15.0 | 30.0 | 1.0 | 14.0 | 5.8 | 320 |
| 65* | 35.0 | 0.0 | 30.0 | 1.0 | 34.0 | 6.1 | 80 |
| 66 | 35.0 | 1.0 | 30.0 | 1.0 | 33.0 | 7.7 | 85 |
| 67 | 35.0 | 2.0 | 30.0 | 1.0 | 32.0 | 8.0 | 94 |
| 68 | 35.0 | 5.0 | 30.0 | 1.0 | 29.0 | 8.0 | 110 |
| 69 | 35.0 | 7.5 | 30.0 | 1.0 | 26.5 | 7.5 | 125 |
| 70 | 35.0 | 10.0 | 30.0 | 1.0 | 24.0 | 7.0 | 150 |
| 71* | 35.0 | 13.0 | 30.0 | 1.0 | 21.0 | 6.2 | 180 |
| 72* | 35.0 | 15.0 | 30.0 | 1.0 | 19.0 | 5.7 | 235 |
| 73* | 30.0 | 0.0 | 30.0 | 1.0 | 39.0 | 5.7 | 65 |
| 74 | 30.0 | 1.0 | 30.0 | 1.0 | 38.0 | 7.3 | 69 |
| 75 | 30.0 | 2.0 | 30.0 | 1.0 | 37.0 | 7.7 | 75 |
| 76 | 30.0 | 5.0 | 30.0 | 1.0 | 34.0 | 7.4 | 85 |
| 77 | 30.0 | 7.5 | 30.0 | 1.0 | 31.5 | 7.1 | 95 |
| 78* | 30.0 | 10.0 | 30.0 | 1.0 | 29.0 | 6.7 | 110 |
| 79* | 30.0 | 13.0 | 30.0 | 1.0 | 26.0 | 6.0 | 130 |
| 80* | 30.0 | 15.0 | 30.0 | 1.0 | 24.0 | 5.3 | 175 |

TABLE 3

| No. | Ferrite material compositions (mol %) $Fe_2O_3$ | $Mn_2O_3$ | ZnO | CuO | NiO | Electric characteristics Specific resistance log ρ (Ω · cm) | Magnetic permeability μ (—) |
|---|---|---|---|---|---|---|---|
| 81* | 25.0 | 0.0 | 30.0 | 1.0 | 44.0 | 5.2 | 51 |
| 82 | 25.0 | 1.0 | 30.0 | 1.0 | 43.0 | 7.0 | 54 |
| 83 | 25.0 | 2.0 | 30.0 | 1.0 | 42.0 | 7.3 | 59 |
| 84 | 25.0 | 5.0 | 30.0 | 1.0 | 39.0 | 7.1 | 67 |
| 85 | 25.0 | 7.5 | 30.0 | 1.0 | 36.5 | 7.0 | 73 |
| 86* | 25.0 | 10.0 | 30.0 | 1.0 | 34.0 | 6.4 | 88 |
| 87* | 25.0 | 13.0 | 30.0 | 1.0 | 31.0 | 5.6 | 105 |
| 88* | 25.0 | 15.0 | 30.0 | 1.0 | 29.0 | 4.9 | 140 |
| 89* | 20.0 | 0.0 | 30.0 | 1.0 | 49.0 | 4.6 | 35 |
| 90* | 20.0 | 1.0 | 30.0 | 1.0 | 48.0 | 6.2 | 38 |
| 91* | 20.0 | 2.0 | 30.0 | 1.0 | 47.0 | 6.7 | 42 |
| 92* | 20.0 | 5.0 | 30.0 | 1.0 | 44.0 | 6.3 | 50 |
| 93* | 20.0 | 7.5 | 30.0 | 1.0 | 41.5 | 5.9 | 55 |
| 94* | 20.0 | 10.0 | 30.0 | 1.0 | 39.0 | 5.6 | 70 |
| 95* | 20.0 | 13.0 | 30.0 | 1.0 | 36.0 | 5.0 | 87 |
| 96* | 20.0 | 15.0 | 30.0 | 1.0 | 34.0 | 4.4 | 120 |
| 97* | 15.0 | 0.0 | 30.0 | 1.0 | 54.0 | 3.9 | 18 |
| 98* | 15.0 | 1.0 | 30.0 | 1.0 | 53.0 | 5.4 | 20 |
| 99* | 15.0 | 2.0 | 30.0 | 1.0 | 52.0 | 5.8 | 25 |
| 100* | 15.0 | 5.0 | 30.0 | 1.0 | 49.0 | 5.4 | 33 |
| 101* | 15.0 | 7.5 | 30.0 | 1.0 | 46.5 | 5.0 | 40 |
| 102* | 15.0 | 10.0 | 30.0 | 1.0 | 44.0 | 4.5 | 55 |
| 103* | 15.0 | 13.0 | 30.0 | 1.0 | 41.0 | 3.8 | 70 |
| 104* | 15.0 | 15.0 | 30.0 | 1.0 | 39.0 | 3.2 | 100 |

TABLE 4

| No. | Ferrite material compositions (mol %) $Fe_2O_3$ | $Mn_2O_3$ | ZnO | CuO | NiO | Electric characteristics Specific resistance log ρ (Ω · cm) | Magnetic permeability μ (—) |
|---|---|---|---|---|---|---|---|
| 201 | 44.0 | 5.0 | 30.0 | 0.0 | 21.0 | 7.8 | 210 |
| 202 | 44.0 | 5.0 | 30.0 | 1.0 | 20.0 | 8.0 | 280 |
| 203 | 44.0 | 5.0 | 30.0 | 2.0 | 19.0 | 8.2 | 310 |
| 204 | 44.0 | 5.0 | 30.0 | 3.0 | 18.0 | 7.9 | 325 |
| 205 | 44.0 | 5.0 | 30.0 | 4.0 | 17.0 | 7.5 | 310 |
| 206 | 44.0 | 5.0 | 30.0 | 5.0 | 16.0 | 7.1 | 315 |
| 207* | 44.0 | 5.0 | 30.0 | 6.0 | 15.0 | 6.1 | 320 |
| 208* | 44.0 | 5.0 | 30.0 | 7.0 | 14.0 | 4.9 | 300 |
| 209* | 44.0 | 5.0 | 30.0 | 8.0 | 13.0 | 4.1 | 305 |

TABLE 5

| No. | Ferrite material compositions (mol %) $Fe_2O_3$ | $Mn_2O_3$ | ZnO | CuO | NiO | Electric characteristics Specific resistance log ρ (Ω · cm) | Magnetic permeability μ (—) | Curie temperature (° C.) |
|---|---|---|---|---|---|---|---|---|
| 301 | 44.0 | 5.0 | 1.0 | 1.0 | 49.0 | 7.1 | 15 | 550 |
| 302 | 44.0 | 5.0 | 3.0 | 1.0 | 47.0 | 7.3 | 20 | 515 |
| 303 | 44.0 | 5.0 | 6.0 | 1.0 | 44.0 | 7.4 | 35 | 465 |
| 304 | 44.0 | 5.0 | 10.0 | 1.0 | 40.0 | 7.6 | 55 | 420 |
| 305 | 44.0 | 5.0 | 15.0 | 1.0 | 35.0 | 7.6 | 110 | 340 |
| 306 | 44.0 | 5.0 | 25.0 | 1.0 | 25.0 | 7.7 | 230 | 275 |
| 307 | 44.0 | 5.0 | 30.0 | 1.0 | 20.0 | 8.0 | 300 | 165 |
| 308 | 44.0 | 5.0 | 33.0 | 1.0 | 17.0 | 8.1 | 355 | 130 |
| 309 | 44.0 | 5.0 | 35.0 | 1.0 | 15.0 | 8.0 | 400 | 110 |

Subsequently, above described weighed components for respective samples were combined with pure water and partial stabilized zirconia (PSZ) balls in a pot mill made of vinyl chloride, sufficiently mixed and grounded using a wet process. The ground product was dried by evaporation, and then calcined at a temperature of 750° C. for 2 hours. The calcined product obtained thus was again combined with a polyvinyl butyral-based binder (organic binder), ethanol (organic solvent) and PSZ balls in the pot mill made of vinyl chloride, sufficiently mixed and ground to obtain a slurry (a ceramic slurry) including the ferrite material.

Then, the slurry of the ferrite material obtained as described above was shaped into a sheet having a thickness of 25 μm using a doctor blade method. The obtained shaped structure was punched at a size of a length of 50 mm and a width of 50 mm to manufacture a green sheet of ferrite material.

(Measurement of Magnetic Permeability)

The plurality of green sheets of ferrite material manufactured as described above were stacked so that a total thickness could amount to 1.0 mm, and pressed at a temperature of 60° C. and a pressure of 100 MPa for 60 seconds to manufacture a compression block. Then, the compression block was cut into a ring shape having an external diameter of 20 mm and an internal diameter of 12 mm to manufacture a ring-type shaped structure.

The ring-type shaped structure obtained as described above was heated at 400° C. in the air to sufficiently remove fat components. Then, a temperature and an oxygen partial pressure in a firing furnace were adjusted in advance by feeding a $N_2$—$H_2$—$H_2O$ mixed gas into the firing furnace, and the ring-type shaped structure was then put into the firing furnace, and fired at a temperature of 950 to 1,000° C. and an oxygen partial pressure of $1.8\times10^{-2}$ Pa (a Cu—$Cu_2O$ average oxygen partial pressure at 950° C.) to $6.7\times10^{-2}$ Pa (a Cu—$Cu_2O$ average oxygen partial pressure at 1,000° C.) for 2 to 5 hours. As a result, a ring-type sample was obtained.

Then, an annealed copper wire was wound around each ring-type sample 20 times, and the impedance at a frequency of 1 MHz was measured using an impedance analyzer (E4991A commercially available from Agilent Technologies Inc.), and the magnetic permeability μ (–) was calculated from the measured value. The results are listed together in Tables 1 to 5.

Also, a magnetic field of 1 T (Tesla) was applied to the ring-type samples manufactured as Sample Nos. 301 to 309 listed in Table 5 using a vibrating sample magnetometer (VSM-5-15 commercially available from Toei Industry Co., Ltd), and measured for dependence of a temperature on saturation. Then, a Curie point Tc was calculated from the dependence of the temperature on saturation. The results are listed together in Table 5.

(Measurement of Specific Resistance)

Figure 5:
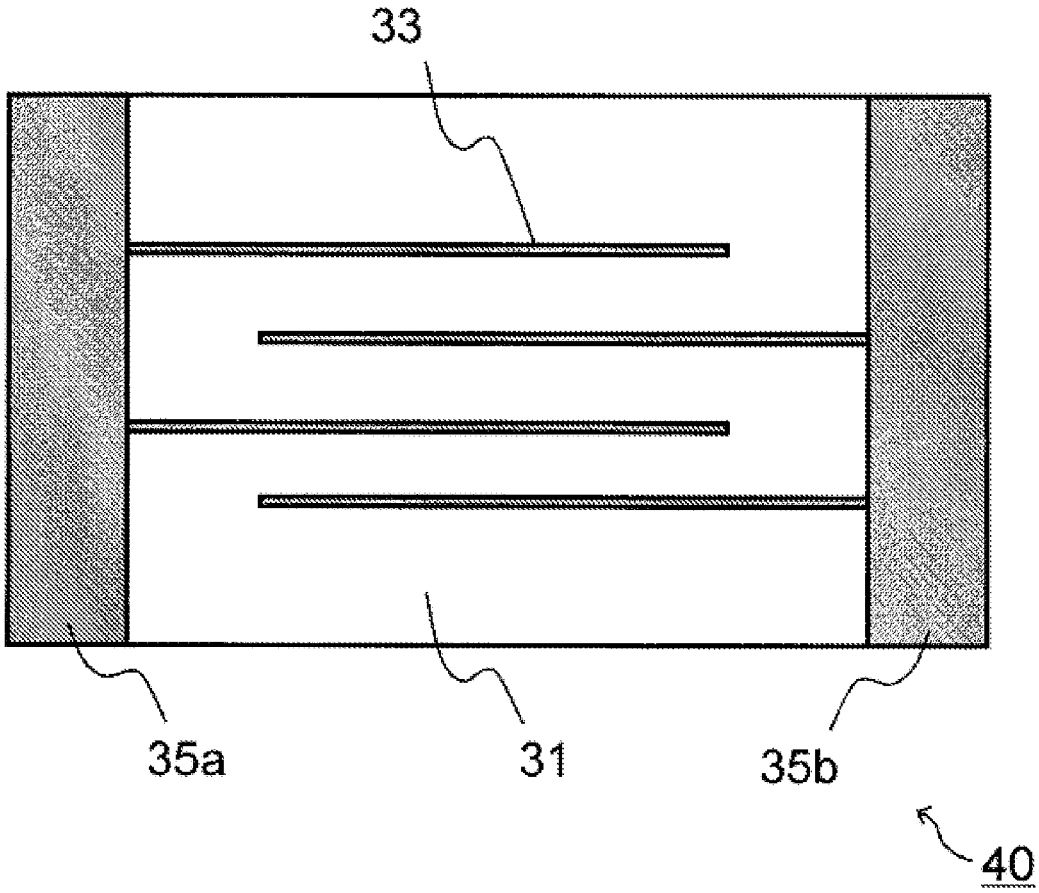
FIG. 5 is a schematic cross-sectional view of a multilayer capacitor manufactured as a sample for measuring the specific resistance of a magnetic layer.

Separately, a vehicle including an organic solvent and a resin was added to and kneaded with copper powder to prepare a conductive paste containing copper (hereinafter referred to as "copper paste for inner conductors"). The copper paste for inner conductors was screen-printed on a surface of the green sheet of a ferrite material manufactured as described above to form a conductive paste layer. Here, the conductive paste layer was formed to have a pattern corresponding to the internal electrode 33 of the multilayer capacitor 40. See, FIG. 5.

Subsequently, a given number of the green sheets of ferrite material having a predetermined pattern formed thereon were properly stacked on the conductive paste layer, fit between the green sheets of ferrite material having no conductive paste layer formed thereon, and pressed at a temperature of 60° C. and a pressure of 100 MPa to manufacture a compression block. Then, the compression block was cut to a predetermined size to manufacture stacked bodies.

The stacked bodies obtained thus were heated at 400° C. at an oxygen partial pressure at which copper is not oxidized to sufficiently remove fat components. Then, a temperature and an oxygen partial pressure in a firing furnace were adjusted in advance by feeding an $N_2$—$H_2$—$H_2O$ mixed gas to the firing furnace, and the stacked bodies were then put into the firing furnace, and fired at a temperature of 950 to 1,000° C. and an oxygen partial pressure of $1.8\times10^{-2}$ Pa (a Cu—$Cu_2O$ average oxygen partial pressure at 950° C.) to $6.7\times10^{-2}$ Pa (a Cu—$Cu_2O$ average oxygen partial pressure at 1,000° C.) for 2 to 5 hours. As a result, the sintered stacked bodies were obtained.

The sintered stacked bodies were put together with water into a barrel port of a centrifugal barrel machine, and subjected to centrifugal barrel treatment to expose internal electrodes (conductive paste layers) from the sintered stacked bodies.

Thereafter, a conductive paste including copper powder, a glass frit and a vehicle (hereinafter referred to as "copper paste for external electrodes") was prepared. Then, the copper paste for external electrodes was applied onto both ends (a section having internal electrodes exposed therefrom) of the centrifugally barrel-treated sintered stacked body using a dipping process, and then baked at a temperature of 900° C. and an oxygen partial pressure of $4.3\times10^{-3}$ Pa (a Cu—$Cu_2O$ average oxygen partial pressure at 900° C.) to form external electrodes. Accordingly, as a sample for measuring specific resistance, the multilayer capacitor 40 shown in FIG. 5 was manufactured. The multilayer capacitor 40 includes internal electrodes 33 buried in a magnetic layer (sintered ferrite material) 31 and connected to external electrodes 35*a* and 35*b*.

Then, the sample for measuring specific resistance (multilayer capacitor 40) was measured for an electric current value flowing when a voltage of 50 V was applied between the external electrodes 35*a* and 35*b* for 30 seconds. Then, a resistance value was calculated from the electric current value, and the specific resistance ρ(Ω·cm) was calculated as log ρ from the shape of the sample. The results are listed together in Tables 1 to 5.

As apparent from Tables 1 to Table 5, for the compositions of the ferrite material containing $Fe_2O_3$, $Mn_2O_3$, NiO, ZnO and CuO, the $Fe_2O_3$ content and the $Mn_2O_2$ content are found within a range of zone Z shown in FIG. 3. In addition, in the samples in which the CuO content is 5 mol % or less, the specific resistance ρ was yielded as a log ρ of 7 or more, and thus the sufficiently high specific resistance was achieved. On the other hand, in the samples in which the $Fe_2O_3$ content and the $Mn_2O_3$ content were found out of the range of zone Z shown in FIG. 3 or the CuO content exceeded 5 mol %, the specific resistance ρ was yielded as a log ρ of less than 7.

Referring to Tables 1 to 5, in the samples in which the $Fe_2O_3$ content and the $Mn_2O_3$ content were found in the range of zone Z shown in FIG. 3 and the ZnO content was 6 mol % or more, the magnetic permeability μ was also 35 or more, and thus a level of the magnetic permeability which was practical for the magnetic layer was achieved. Also, in the samples in which the $Fe_2O_3$ content and the $Mn_2O_3$ content were found in the range of zone Z shown in FIG. 3 and the ZnO content was 33 mol % or less, the Curie point exceeded 130° C., and thus a sufficient coil operating temperature was achieved.

Example 1

The common mode choke coil 10 shown in FIGS. 1 and 2 was manufactured by the manufacturing method of the first exemplary embodiment. In the present experimental example, the following conditions were applied.

In the above-described process A, as the first magnetic layer 1, a substrate (44.0 mol % $Fe_2O_3$, 5.0 mol % $Mn_2O_3$, 30.0 mol % ZnO, 19.0 mol % NiO, and 2.0 mol % CuO) formed of a sintered Ni—Zn—Cu-based ferrite material was used.

In the above-described process (b), a glass paste using photosensitive borosilicate glass ($SiO_2$—$Bi_2O_3$—CaO—$K_2O$, which will be equally applied below) was coated by a printing process, and then heat-treated at 900° C. for 30 minutes to obtain glass ceramics. The glass ceramics were fired to form a non-magnetic sublayer 3*a*.

In the above-described process (c), the non-magnetic sublayer 3*a* was selectively plated by a semi-additive process, thereby forming a withdrawal part 2*a*. More particularly, a seed layer (formed of Cu in this Experimental Example, but may be formed of Cu/Ti or Cu/Cr) was formed throughout the circumferential surface of the non-magnetic layer 3*a* by a sputtering process. A photosensitive photoresist was patterned on the seed layer by photolithography. Then, using the seed layer exposed without being covered with the resist, the openings of the resist pattern were filled with copper by electroplating, and the resist was peeled. Thereby, the exposed seed layer portion was removed by etching. This was equally applied to forming the body part 2*b* in the above-described process (e), the body part 4*b* in above-described process (g), and the withdrawal part 4*a* in the above-described process (i).

In the above-described process (d), a glass paste using the photosensitive borosilicate glass was coated on the non-magnetic sublayer 3*a* by a printing process, and a via hole 6*a* was formed by photolithography. Then, the non-magnetic sublayer 3*a* was heat-treated under a $N_2$—$H_2$—$H_2O$ mixed gas atmosphere, in which an oxygen partial pressure was adjusted to $1.8\times10^{-2}$ Pa, at 950° C. for 30 minutes, thereby obtaining glass ceramics. The glass ceramics were fired to form a non-magnetic sublayer 3*b*. This was equally applied to form the non-magnetic sublayer 3*c* in the above-described process (f), the non-magnetic sublayer 3*d* and the and via hole 6*b* in the above-described process (h), and the non-magnetic sublayer 3*e* in the above-described process (j).

In the above-described process (k), a calcined product of a Ni—Mn—Zn—Cu-based ferrite material (44.0 mol % $Fe_2O_3$, 5.0 mol % $Mn_2O_3$, 30.0 mol % ZnO, 19.0 mol % NiO, and 2.0 mol % CuO) was ground, and a vehicle including an organic binder and an organic solvent was added thereto and kneaded with the ground calcined product to prepare a magnetic paste. The magnetic paste was coated on the non-magnetic layer 3 by a printing process, and the non-magnetic layer 3 was then heat-treated under a $N_2$—$H_2$—$H_2O$ mixed gas atmosphere, in which an oxygen partial pressure was adjusted to $1.8\times10^{-2}$ Pa, at 950° C. for 30 minutes, thereby obtaining a ferrite material. The ferrite material was fired to form a second magnetic layer 5. Further, the Ni—Mn—Zn—Cu-based ferrite material used herein has the same composition as in No. 203 shown in Table 4.

Thereby, the obtained stacked body 7 was diced into separate pieces. Dimensions of one element were set to a length of 0.5 mm, a width of 0.65 mm, and a height of 0.3 mm.

In the above-described process (l), the stacked body 7 was applied with a copper paste for external electrodes, and the obtained structure was heat-treated under an atmosphere having an oxygen partial pressure of $4.3\times10^{-3}$ Pa at 900° C. for 5 minutes, thereby baking copper. Thereby, external electrodes 9*a* to 9*d* were formed. In this way, the common mode choke coil 10 of this Experimental Example was manufactured.

Comparative Example 1

A common mode choke coil was manufactured in the same manner as in Experimental Example 2, except that the conductive coils 2 and 4 were manufactured using silver instead of copper (using silver as a seed layer and an electroplating), each of the firings for forming the non-magnetic layers 3*b* to 3*e* and the firing for forming the second magnetic layer 5 was performed at 900° C. in the air, the external electrodes 9*a* to 9*d* were manufactured by firing a silver paste for external electrodes in the air, the silver paste being obtained by replacing the copper powder with silver powder in the copper paste for external electrodes, and a magnetic paste using a Ni—Mn—Zn—Cu-based ferrite material (44.0 mol % $Fe_2O_3$, 5.0 mol % $Mn_2O_3$, 30.0 mol % ZnO, 13.0 mol % NiO, and 8.0 mol % CuO) was used as the material of the second magnetic layer 5. Also, the Ni—Mn—Zn—Cu-based ferrite material used herein has the same composition as No. 209 listed in Table 4.

Humidity resistance load tests were performed on the common mode choke coils of Experimental Example 1 and Comparative Example 1 manufactured as described above. More particularly, a direct current voltage of 5 V was applied between the conductive coils 2 and 4 of the common mode choke coil under the conditions of 70° C. and 95% relative humidity (RH), the insulation resistance (IR) was measured at the beginning of the test and after being applied for 1,000 hours using an electrometer R8340A commercially available from Advantest Corp., and log IR and its variations were calculated. The results are listed in Table 6.

TABLE 6

| | Experimental Example 1 | | Comparative Example 1 | |
|---|---|---|---|---|
| Time (hr) | Log IR (Ω) | Variation in log IR (%) | Log IR (Ω) | Variation in log IR (%) |
| 0 | 7.9 | 0 | 8.8 | 0 |
| 1000 | 7.7 | −2.5 | 4.5 | 48.8 |

As seen from Table 6, it was confirmed that, in the common mode choke coil of Experimental Example 1, a change in insulation resistance was significantly reduced even when a humidity resistance load test was performed, compared to the common mode choke coil of Comparative Example 1, and the common mode choke coil had high reliability. Also, in the common mode choke coil of Experimental Example 1, the insulation resistance at the beginning of the test may be maintained at a similar level as in the common mode choke coil of Comparative Example 1.

Example 2

The common mode choke coils 10 shown in FIGS. 1 to 2 were manufactured according to the manufacturing method according to the second embodiment. In this Experimental Example, and the following conditions were applied.

In the above-described process (m), a paste, which was obtained using alumina powder with a binder and a solvent, was applied on an alumina substrate using a printing process, and a solvent fraction was then dried and coated. Then the coating was used as a holding layer (not shown). A magnetic paste was prepared by grinding a calcined product of a Ni—Mn—Zn—Cu-based ferrite material (44.0 mol % $Fe_2O_3$, 5.0 mol % $Mn_2O_3$, 30.0 mol % ZnO, 19.0 mol % NiO, and 2.0 mol % CuO) on the holding layer, adding a vehicle including an organic binder and an organic solvent to the calcined product and kneading the calcined product with the vehicle. Then, the magnetic paste was coated on the non-magnetic layer 3 using a printing process, and dried. Also, the Ni—Mn—Zn—Cu-based ferrite material used herein has the same composition as No. 203 listed in Table 4.

In the above-described process (n), a glass paste using photosensitive borosilicate glass ($SiO_2$—$Bi_2O_3$—CaO—$K_2O$: the same will apply hereinafter) was coated using a printing process, and dried to form a material layer of the non-magnetic layer 3*a*. A copper paste for inner conductors was coated on the material layer using a printing process, and dried to form a withdrawal part 2*a*. Thereafter, a glass paste using photosensitive borosilicate glass was coated using a printing process, and a via hole 6*a* was formed using photolithography. Then, the glass paste was dried to form a material layer of the non-magnetic sublayer 3*b*. A copper paste for inner conductors was coated on the material layer using a printing process, and dried to form a body part 2*b*. A glass paste using photosensitive borosilicate glass was coated on the body part 2*b* using a printing process, and dried to form a material layer of the non-magnetic sublayer 3*c*. A copper paste for inner conductors was coated on the material layer using a printing process, and dried to form a body part 4*b*. A glass paste using photosensitive borosilicate glass was coated on the body part 4*b* using a printing process, and a via hole 6*b* was formed using photolithography. Then, the glass paste was dried to form a material layer of the non-magnetic sublayer 3*d*. A copper paste for inner conductors was coated on the material layer using a printing process, and dried to form a withdrawal part 4*a*.

In the above-described process (o), a magnetic paste using the same Ni—Mn—Zn—Cu-based ferrite material as used in process (m) was coated on the material layer of the non-magnetic layer 3 using a printing process, and dried.

The unfired stacked body obtained in this way was diced into separate pieces. Dimensions of one element were set to a length of 0.5 mm, a width of 0.65 m and a height of 0.3 mm.

In the above-described process (p), the heat treatment was performed at 950° C. for 2 hours under a $N_2$—$H_2$—$H_2O$ mixed gas atmosphere in which the oxygen partial pressure was adjusted to $1.8\times10^{-2}$ Pa to fire the glass ceramics and ferrite material at the same time, thereby forming the first magnetic layer 1, the non-magnetic layer 3 and the second magnetic layer 5.

In the above-described process (q), the copper paste for external electrodes was applied, and copper was baked by heat-treating the obtained structure at 900° C. for 5 minutes under the atmosphere such as an oxygen partial pressure of $4.3\times10^{-3}$ Pa, thereby forming external electrodes 9*a* to 9*d*. As described above, the common mode choke coil 10 of this Experimental Example was manufactured.

Comparative Example 2

A common mode choke coil was manufactured in the same manner as in Experimental Example 2, except that the conductive coils 2 and 4 were manufactured using silver instead of copper (using a silver paste for inner conductors obtained by replacing the copper powder with silver powder in the copper paste for inner conductors), the firings for forming the first magnetic layer 1, the non-magnetic layer 3 and the second magnetic layer 5 were performed at 900° C. in the air at the same time, the external electrodes 9*a* to 9*d* were manufactured by firing a silver paste for external electrodes in the air, the silver paste being obtained by replacing the copper powder with silver powder in the copper paste for external electrodes, and a magnetic paste using a Ni—Mn—Zn—Cu-based ferrite material (44.0 mol % $Fe_2O_3$, 5.0 mol % $Mn_2O_3$, 30.0 mol % ZnO, 13.0 mol % NiO, and 8.0 mol % CuO) was used as the material of the second magnetic layer 5. Also, the Ni—Mn—Zn—Cu-based ferrite material used herein has the same composition as No. 209 listed in Table 4.

Like the common mode choke coils of Experimental Example 1 and Comparative Example 1, humidity resistance load tests were performed on the common mode choke coils of Experimental Example 2 and Comparative Example 2 manufactured as described above. As a result, it was confirmed that the common mode choke coil of Experimental Example 2 had higher reliability than the common mode choke coil of Comparative Example 2. Also, it was confirmed that, in the common mode choke coil of Experimental Example 1, the interconnection resistance (direct current resistance) of the conductive coils 2 and 4 themselves can be more reduced than the common mode choke coil of Experimental Example 1.

In embodiments of a common mode choke coil according to the present disclosure, the non-magnetic layer is formed of sintered glass ceramics, and the conductive coil is formed of a conductor containing copper. That is, since the glass ceramics are used as the material of the non-magnetic layer, and copper is used as the material of the conductive coil as well, the migration between the conductive coils may be effectively prevented, compared with a case in which silver is used as the material of the conductive coil. As a result, the common mode choke coil having high reliability is provided.

In the present disclosure, it should be understood that the expression "a non-magnetic layer and a second magnetic layer are stacked on a first magnetic layer" refers simply to the relative vertical relationship between these layers.

In embodiments of a common mode choke coil according to the present disclosure, Cu used in the material of the conductive coil may be prevented from being oxidized into Cu2O by performing the firing at an oxygen partial pressure (reducing atmosphere) equal to or less than a Cu—Cu2O average oxygen partial pressure, as will be described below in a method for manufacturing a common mode choke coil. Thus, it is possible to prevent an increase in interconnection resistance of the conductive coil.

Also, in embodiments of a common mode choke coil according to the present disclosure, at least one of the first magnetic layer and the second magnetic layer is formed of a sintered ferrite material containing Fe2O3, Mn2O3, NiO, ZnO and CuO, and the sintered ferrite material has a CuO-reduced content of 5 mol % or less (but not 0 mol %). When the CuO-reduced content is set to a low content of 5 mol % or less as described above, the reduction resistance of the ferrite material is increased when the ferrite material is sintered, and a decrease in specific resistance of the magnetic layer when Cu is reduced into Cu2O may be suppressed to an available extent even when the firing is performed at the oxygen partial pressure (reducing atmosphere) equal to or less than the Cu—Cu2O average oxygen partial pressure.

Also, in embodiments of a common mode choke coil according to the present disclosure, the sintered ferrite material has an Fe2O3-reduced content of not less than 25 mol % but more than 47 mol % and a Mn2O3-reduced content of 1 mol % or more and less than 7.5 mol %, or an Fe2O3-reduced content of not less than 35 mol % but not more than 45 mol % and a Mn2O3-reduced content of not less than 7.5 mol % but not more than 10 mol %. As described above, when Fe2O3 is used together with Mn2O3, and the Fe2O3-reduced content and the Mn2O3-reduced content are a combined and selected respectively from the above-described ranges, reduction of Fe2O3 into Fe3O4 (FeO.Fe2O3) may be effectively prevented during sintering of the ferrite material. Even when the firing is performed at the oxygen partial pressure (reducing atmosphere) equal to or less than the Cu—Cu2O average oxygen partial pressure, a decrease in specific resistance of the magnetic layer according to the reduction of Fe2O3 into Fe3O4 may be prevented.

For example, according to common mode choke coil of the present disclosure, even when the glass ceramics are used as the material of the non-magnetic layer, the migration between the conductive coils may be effectively prevented. In addition, both of an increase in interconnection resistance of the conductive coil and a decrease in specific resistance of the magnetic layer may be effectively prevented.

Also, components of the magnetic layer may be determined by breaking the common mode choke coil and quantitatively analyzing a fracture surface of the magnetic layer using wavelength dispersive X-ray spectroscopy (WDX). When it is assumed that the entire Cu in the magnetic layer is in the form of CuO, the CuO-reduced content means a CuO content when Cu is calculated based on CuO. More particularly, the CuO-reduced content is examined by quantitatively analyzing Cu in the magnetic layer using WDX. In addition, the expression " . . . -reduced content" has the same meaning.

In embodiments of the present disclosure in which the first magnetic layer and the second magnetic layer are connected through inner coil parts of the two conductive coils disposed in the non-magnetic layer, a magnetic coupling property between coils may be enhanced, and a common mode choke coil having higher common mode impedance may be provided.

According to a manufacturing method consistent with the present disclosure, because copper is used as the material of the conductive coil, the migration between the conductive coils may be effectively prevented, compared with a case in which silver is used as the material of the conductive coil. Also, a common mode choke coil having high reliability can be provided.

According to a manufacturing method consistent with the present disclosure, since the non-magnetic layer is at least partially formed by firing the glass ceramics at the oxygen partial pressure equal to or less than the Cu—$Cu_2O$ average oxygen partial pressure in the presence of the conductor containing copper, Cu used in the material of the conductive coil may be prevented from being oxidized into $Cu_2O$, and an increase in interconnection resistance of the conductive coil may be prevented.

Also, according to a manufacturing method of the present disclosure, because the second magnetic layer is formed by firing the ferrite material containing $Fe_2O_3$, $Mn_2O_3$, NiO, ZnO and CuO at the oxygen partial pressure equal to or less than the Cu—$Cu_2O$ average oxygen partial pressure in the presence of the conductor containing copper, and the CuO content in the ferrite material is 5 mol % or less (but not 0 mol %), a decrease in specific resistance of the magnetic layer according to the reduction of Cu into $Cu_2O$ may be suppressed to an available extent. In general, CuO has a relatively low melting point, compared with the other main ingredients. So, when it is assumed that the CuO content is 5 mol % or less, a sinter having a high sintering property (or sintering density) may not be obtained when a firing temperature is not increased to approximately 1,050 to 1,250° C. in the case of the firing generally performed at an air atmosphere. On the other hand, according to the manufacturing method of the present disclosure, because the firing is performed at the oxygen partial pressure equal to or less than the Cu—$Cu_2O$ average oxygen partial pressure, a sinter having a high sintering property may be obtained at a temperature equal to or less than the melting point of Cu, for example, 950 to 1,000° C.

Also, according to embodiments of a manufacturing method consistent with the present disclosure, the second magnetic layer is formed by firing the ferrite material containing $Fe_2O_3$, $Mn_2O_2$, NiO, ZnO and CuO at the oxygen partial pressure equal to or less than the Cu—$Cu_2O$ average oxygen partial pressure in the presence of the conductor containing copper, and the ferrite material has an $Fe_2O_3$ content of not less than 25 mol % but not more than 47 mol % and a $Mn_2O_2$ content of 1 mol % or more and less than 7.5 mol %, or an $Fe_2O_3$ content of not less than 35 mol % but not more than 45 mol % and a $Mn_2O_2$ content of not less than 7.5 mol % but not more than 10 mol %. Thus, a decrease in specific resistance of the magnetic layer according to the reduction of $Fe_2O_3$ into $Fe_2O_4$ may be prevented.

In embodiments in which the sintered ferrite material is used as the first magnetic layer, the sintered ferrite material may be any ferrite material that is fired in advance under any proper conditions.

In embodiments of a method consistent with the present disclosure where the second magnetic layer is formed by firing a ferrite material at an oxygen partial pressure equal to or less than a Cu—$Cu_2O$ average oxygen partial pressure in the presence of a conductor containing copper, where the ferrite material used contains $Fe_2O_3$, $Mn_2O_2$, NiO, ZnO and CuO, and has an $Fe_2O_3$ content of not less than 25 mol % but more than 47 mol % and a $Mn_2O_2$ content of 1 mol % or more and less than 7.5 mol %, or an $Fe_2O_3$ content of not less than 35 mol % but more than 45 mol % and a $Mn_2O_2$ content of not less than 7.5 mol % but more than 10 mol %, and has a CuO reduced content of 5 mol %, the firing for forming the non-magnetic layer, the firing for forming the second magnetic layer and the firing for forming the first magnetic layer may be performed at the same time. According to this aspect, both of the firing for forming the second magnetic layer and the firing for forming the first magnetic layer may be achieved at a low temperature. In addition, according to this aspect, since both of the firings are performed together with the firing for forming the non-magnetic layer, Cu used in the material of the conductive coil may be further prevented from being oxidized into $Cu_2O$. As a result, an increase in interconnection resistance of the conductive coils may be more effectively prevented. Also, according to the aspect, since the specific resistance and sintering densities of the second magnetic layer and the first magnetic layer may be maintained at high levels, the insulation resistance and reliability of the obtained common mode choke coil may be enhanced.

The common mode choke coil obtained by the manufacturing method according to the present disclosure may be used for high-speed data communication through a differential signaling mode, and a variety of applications requiring reduction and removal of common mode noise.

What is claimed is:

1. A common mode choke coil comprising a non-magnetic layer and a second magnetic layer stacked on a first magnetic layer, and two conductive coils facing one another included in the non-magnetic layer, wherein the non-magnetic layer is formed of sintered glass ceramics, the conductive coil is formed of a conductor containing copper, at least one of the first magnetic layer and the second magnetic layer is formed of a sintered ferrite material containing $Fe_2O_3$, $Mn_2O_3$, NiO, ZnO and CuO, and the sintered ferrite material has an $Fe_2O_3$-reduced content of not less than 25 mol % but not more than 47 mol % and a $Mn_2O_3$-reduced content of 1 mol % or more and less than 7.5 mol %, or $Fe_2O_3$-reduced content of not less than 35 mol % but not more than 45 mol % and a $Mn_2O_3$-reduced content of not less than 7.5 mol % but not more than 10 mol %, and a CuO reduced content of less than 5 mol %, the conductive coil and at least one of the first magnetic layers and the second magnetic layer are co-sintered.

2. The common mode choke coil according to claim 1, wherein the first magnetic layer and the second magnetic layer are connected through inner coil parts of the two conductive coils disposed in the non-magnetic layer.

* * * * *